United States Patent [19]

Sawaide et al.

[11] Patent Number: 5,049,015

[45] Date of Patent: Sep. 17, 1991

[54] ANCHORING STRUCTURE

[75] Inventors: Minoru Sawaide; Noboru Hiraoka, both of Tokyo, Japan

[73] Assignee: Shimizu Construction Co., Ltd., Tokyo, Japan

[21] Appl. No.: 371,773

[22] Filed: Jun. 27, 1989

[30] Foreign Application Priority Data

Jun. 29, 1988 [JP] Japan ..... 63-159266

[51] Int. Cl.[5] ..... F16B 39/02

[52] U.S. Cl. ..... 411/82; 411/386; 52/704

[58] Field of Search ..... 411/82, 258, 386, 69; 52/704

[56] References Cited

U.S. PATENT DOCUMENTS

| | | | |
|---|---|---|---|
| 991,517 | 5/1911 | Kennedy | 411/82 X |
| 1,045,562 | 11/1912 | Kennedy | 411/82 X |
| 4,063,582 | 12/1977 | Fischer | 411/82 |
| 4,211,049 | 7/1980 | Fischer | 52/704 |
| 4,350,464 | 9/1982 | Brothers | 411/389 X |
| 4,615,554 | 10/1986 | Schilla et al. | 52/704 X |
| 4,630,971 | 12/1986 | Herbst et al. | 411/69 X |
| 4,776,143 | 10/1988 | Pointner | 52/704 X |
| 4,834,602 | 5/1989 | Takasaki | 411/386 |
| 4,840,524 | 6/1989 | Bisping et al. | 52/704 X |

*Primary Examiner*—Robert L. Wolfe
*Assistant Examiner*—Suzanne L. Dino
*Attorney, Agent, or Firm*—Armstrong, Nikaido, Marmelstein, Kubovcik & Murray

[57] ABSTRACT

An anchoring structure comprises an anchor rod which is secured to the inside of an anchor hole in concrete by a cementing material except for an upper section of the rod having a depth of at least 1.5 times the diameter of the anchor hole. The upper end of the anchor rod may be surrounded by an insulating sleeve which fits into the upper section of the anchor hole. The anchor rod may have a continuous groove formed therein, at least one surface of which has a slope of 15°-50°. The depth of the groove is at least as large as the maximum crack width expected to appear around the anchor in the concrete.

11 Claims, 5 Drawing Sheets

ANCHORING STRUCTURE

BACKGROUND OF THE INVENTION

This invention concerns a structure for anchoring a rod, pile or the like (hereinafter called a "rod" or "anchor rod") into concrete, rock or similar material (hereinafter called "concrete") by means of a cementing material such as a resin adhesive.

Such an anchoring method is commonly used for fixing structural members, machinery, equipment, temporary structures and the like in concrete. A typical such structure anchoring is illustrated in FIG. 6 (*a*). As shown in this figure, an anchor rod 1 is fixed in concrete 3 by means of a cementing material 2 which fills the empty portion of an anchor hole 4. FIGS. 8 and 9 respectively illustrate a deformed bar and a threaded bolt which are anchored by this method. The cementing materials which are normally used include epoxy resins, polyester resins and non-contracting cement.

This anchoring method has the advantages that a high positioning accuracy is easier to attain than with other methods, it provides a high-strength anchorage, and it can be rapidly performed. For these reasons, it has been acquiring increasing acceptance in various fields. For example, in the field of civil construction, it is used for anchoring bridge supports, bridge pier studs and shutter supports. In the field of architectural construction, it is used for anchoring exterior equipment, piping brackets, slab reinforcement elements, exterior sign boards and other members.

However, this method can still not be said to have become well established. Reliable design criteria for it are not yet available. Although not very often, pulling-out of an anchor and/or concrete fracture around an anchor actually occurs, especially with larger anchors whose failure is very serious. The reasons for such failures may be related to inadequacies in anchor design.

One of the unique features of these pullout fractures or concrete fractures is that, as shown in FIG. 6 (*b*), the anchor 1 is pulled out together with a cone-shaped piece of concrete 6 (hereinafter called a "cone"), the anchor and the cone 6 resembling the shape of a mushroom.

As a result, a crater-shaped hole is produced in the surface of the concrete body. The hole decreases the load bearing capacities of the nearby anchors, can cause them to fail, and can finally even cause the object which is supported by the anchors to fall down.

One of the reasons why such troubles occur more often with larger anchors may be attributable to the fact that it is very difficult to test larger anchors and there is not so much laboratory or field testing data on them. In many cases, larger anchors have been designed by extrapolating data for smaller anchors on which testing is far easier to conduct and for which much data is readily available.

SUMMARY OF THE INVENTION

It was found by the present inventors that the apparently irregular cone-shaped concrete fracture of adhesive anchors is in fact a highly regular physical phenomenon. As shown in FIGS. 7 (*a*)–7 (*c*), cone-shaped fractures occur at intervals of approximately 1.8 times the hole diameter.

In this invention, a structure is proposed in which an anchor rod is physically insulated from the concrete sides of a hole to a depth corresponding to the height of the uppermost cone. As a result, cone fracture can be prevented, the anchor load can be led deeper into concrete, and a more reliable anchorage can be realized.

The inventors also studied the mechanism by which the anchoring strength of adhesive anchors is determined, and it was found that an increase in the hole diameter has a negative effect on the anchoring strength. The inventors therefore devised an anchoring structure in which this negative effect can be reduced or totally eliminated.

The present invention is an anchoring structure in which an anchor rod is secured inside a hole in a concrete body by means of a cementing material. The rod is insulated from the concrete to a prescribed depth so that there is no shearing force acting on the sides of the hole to the prescribed depth. The insulation may be provided by a sleeve-shaped insulating space having a depth which is at least 1.5 times the hole diameter. The insulating space may be filled with a sleeve. The rod is provided with a continuous ring-shaped or spiral-shaped groove or grooves and/or a thread or threads, the depth or height of the groove of thread being larger than the maximum crack width to be expected in its neighborhood. The side surfaces of the groove and/or thread under the concrete have a slope in the range of 15°–50°.

DESCRIPTION OF THE PREFERRED EMBODIMENT

Figure 6:
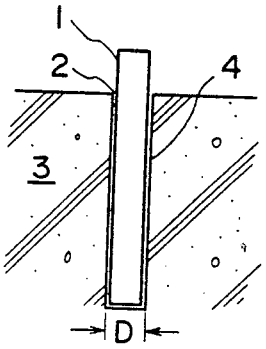
FIG. 6 (a) PRIOR ART
FIGS. 6 (*a*) and (*b*) and FIGS. 7 (*a*), (*b*) and (*c*) show the modes of concrete fracture of conventional adhesive anchors.
Figure 6:
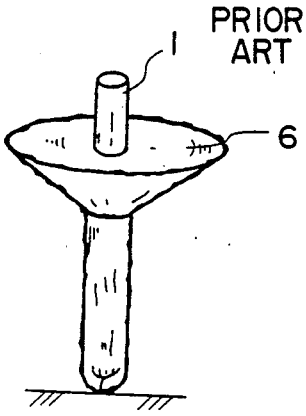
FIG. 6 (b) PRIOR ART
Figure 7:
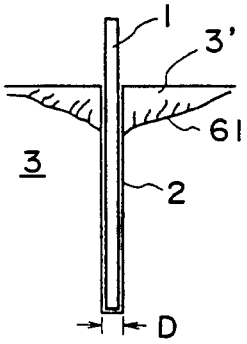
FIG. 7 (a) PRIOR ART
Figure 7:
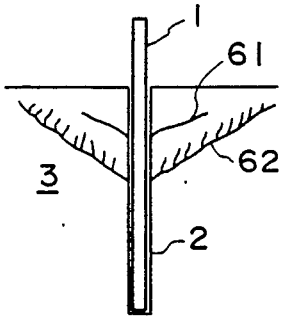
FIG. 7 (b) PRIOR ART
Figure 7:
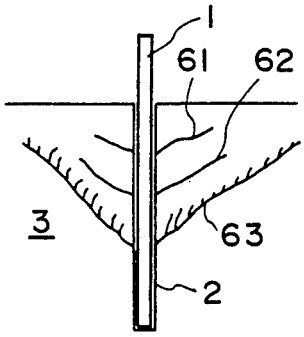
FIG. 7 (c) PRIOR ART

FIGS. 6 and 7 will be referred to in order to explain the modes of concrete fracture of an anchoring structure. In these figures, element number 1 is an anchor rod, 2 is a cementing material, 3 is concrete, 4 is an anchor hole, 6 is a fractured concrete cone, 61 shows the position where the first cone fracture starts, 62 shows the starting position of the second cone fracture, and 63 shows the starting position of the third cone fracture.

An anchor fracture can be explained as follows. When a load is applied to an anchor rod, it produces a shear stress around the anchor rod. When the shear stress reaches the uniaxial shear strength of concrete, the concrete adjacent to the layer of cementing material is sheared off, producing two uneven surfaces. The layer of cementing material does not normally fracture as it is stronger than the concrete. A relative sliding movement between the two uneven surfaces takes place due to the shear stress acting there and such sliding of uneven surfaces in a confined space induces an immediate mutual engagement again due to a kind of wedge action and produces a radial compressive stress perpendicular to the anchor axis, which in turn produces a high frictional resistance there. The radial compressive stress increases the shear strength of concrete far above the uniaxial strength around the anchor by the action of Coulomb's internal friction. The internal and external frictional resistance is the real source of the strength of adhesive anchors.

On the other hand, when the shear fracture of concrete around an anchor occurs, the first cone fracture starts at the depth shown by 61 in FIG. 7, absorbing the strain energy stored in the shallower portion of concrete. This cone fracture is caused by the shock of the shear fracture of the concrete. This cone fracture takes its form gradually as the load increases, while the load bearing capability of the shallower portion is soon totally lost well below the ultimate pullout load.

When the load exceeds the above-mentioned frictional resistance appearing in the portion of the anchor which is deeper than the position where the first cone fracture has started, the final sliding-out of the anchor rod starts and induces the second and third cone fractures at the deeper positions 62 and 63 shown in FIG. 7. The frictional resistance in the deeper portion virtually constitutes the pullout strength of anchors mortared with a sufficiently strong cementing material. The second and third cone fractures little affect the ultimate pullout strength of anchors but damage the concrete body seriously by producing a large, deep crater-shaped hole which may lower the load bearing capacities of the nearby anchors.

A test was conducted to prove the above-described theory using actual anchors. The hole diameter was 34 mm, the depth was 300 mm, the anchor bolt diameter was 30 mm, its length was 400 mm, and an epoxy resin adhesive was used as a cementing material. The anchors were cured for several days after installation.

By analyzing the results of the above test together with the test results available from other sources, it was found that the depth of the position 61 where the first cone fracture starts is in the range of 1.5–2.25 times the anchor hole diameter.

The above-mentioned radial compressive stress which appears when the concrete has been sheared off near the surface of the cementing material under tensile (compressive) loading is represented approximately by Eq. 1 and the resultant anchoring strength by Eq. 2.

$$\sigma_d \approx \frac{2 E_c v}{D} \quad (1)$$

$$P_m = \mu \sigma_d \pi D L' \quad (2)$$

where $\sigma_d$ = radial compressive stress $E_c \approx$ inital Young's modulus of concrete v = unevenness of the sheared concrete surface (average height of the unevenness)

$P_m$ = anchor pullout load (anchor strength)

$\mu$ = coefficient of friction of the sheared surfaces of concrete

D = anchor hole diameter

L' = effective anchor depth $(L' \approx L - 1.82 \times D)$

L = anchor hole depth

The average unevenness and the coefficient of friction in the above equations do not vary much even when the hole diameter is varied. It can be seen from Eq. 1 that the radial compressive stress is nearly inversely proportional to the hole diameter and from Eq. 2, it can be seen that the anchoring strength does not increase as the hole diameter increases. It can be said that an increase in the size of the anchor hole obviously has a negative effect on the anchoring strength.

Figure 4:
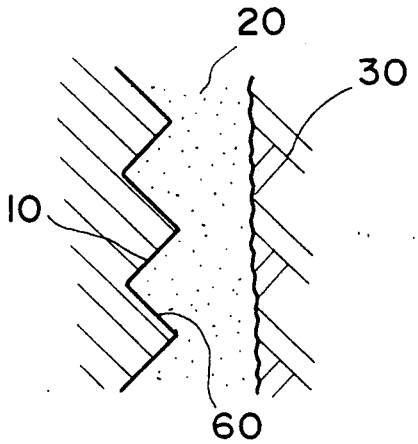
Figure 4:
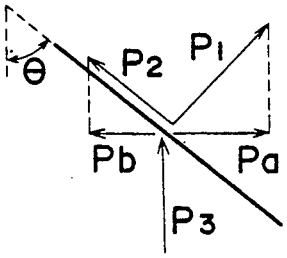
Figure 8:
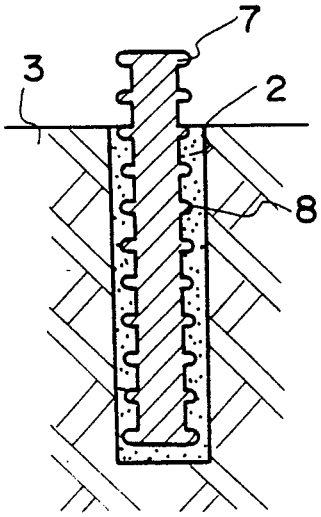
FIG. 8 (a) PRIOR ART
FIGS. 8 (*a*) and (*b*) and FIGS. 9 (*a*) and (*b*) illustrate a conventional adhesive anchor structure and its operating principles.
Figure 8:
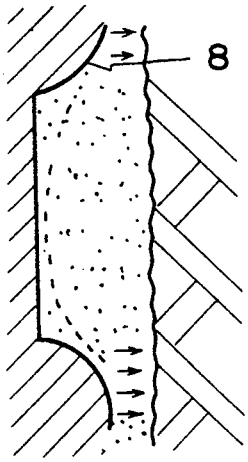
FIG. 8 (b) PRIOR ART

This negative effect is brought about by a reduction in the radial compressive stress due to an increase in the anchor hole diameter. This invention compensates for the reduction in the compressive stress by introducing other mechanisms that generate an additional radial compressive stress. As shown in FIG. 4, when relative movement takes place between the thread surface 60 of an anchor rod and a cementing material 20, force components $P_1$, $P_2$ and $P_a$, $P_b$ are generated on the thread surface, wherein $(P_a - P_b)$ is a newly generated radial compressive stress due to wedge action. The relative movement can appear as a deformation flow of the cementing material and/or a slip of the cementing material on the thread surface. However, in the case of a deformed rod as shown in FIGS. 8 (*a*) and (*b*), which is a typical example of a conventional adhesive anchor, the spacing between the adjacent ribs (threads) 8 is so large that the radial compressive stress generated there can not be very large, since it is dispersed over the entire surface. Thus, the resulting improvement in the anchoring strength is insignificant.

Figure 9:
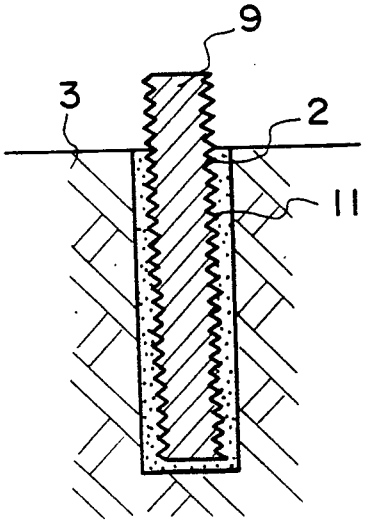
FIG. 9 (a) PRIOR ART
Figure 9:
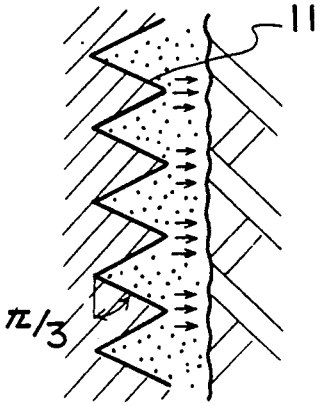
FIG. 9 (b) PRIOR ART

In the case of another conventional example wherein a bolt 9 with an ordinary thread 11 is used as shown in FIGS. 9 (*a*) and (*b*), the inclination of the thread surface is 60° which is too steep to allow a relative movement of the cementing material to generate a sufficient radial compressive stress.

Figure 1:
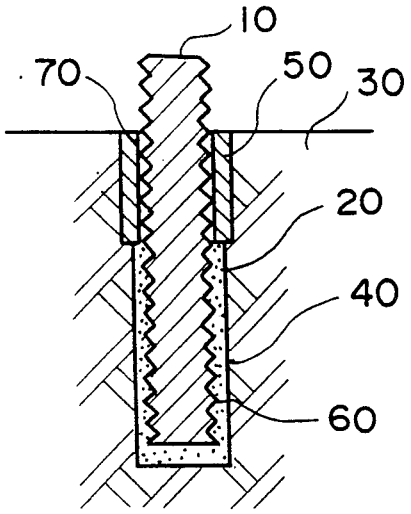
FIG. 1 shows an anchorage structure in accordance with this invention wherein (*a*) shows an overall scheme and (*b*) shows an enlarged section and illustrates the anchoring mechanism.
Figure 1:
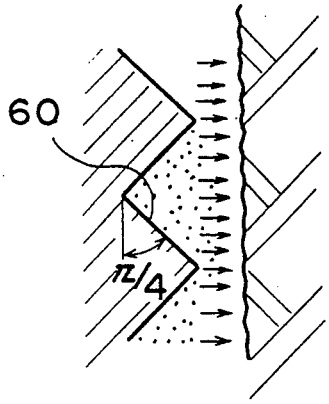

An embodiment of this invention will now be explained referring to FIG. 1.

An anchor rod 10 is secured by means of a cementing material in a hole 40 drilled into a concrete body 30. A sleeve-shaped space 50, which is deeper than 1.5 times the diameter of the hole 40, is provided around the anchor rod 10 and a sleeve 70 is inserted into the space 50. A continuous thread having a slope of 15°–50° 60 is formed on the surface of the rod 10. The height (the distance from the root to the crown) of the continuous thread 60 is chosen to be larger than the maximum crack width which is expected to appear in the nearby concrete. If the slope of the thread 60 is less than 15°, it does not produce a sufficiently high radial compressive stress, and when it is greater than 50°, it is too steep and prevents the cementing material from flowing and/or slipping, so a radial compressive stress does not appear. If the thread height is inadequate, the appearance of a crack in the nearby concrete would make the above mechanism more or less inoperative since the deformation of cementing material would be largely or fully absorbed by the internal deformation of the concrete due to cracking.

The application of a separating agent such as silicone grease that prevents adhesion between the cementing material and the thread surface and lowers frictional resistance is effective for producing a higher compressive stress.

Figure 5:
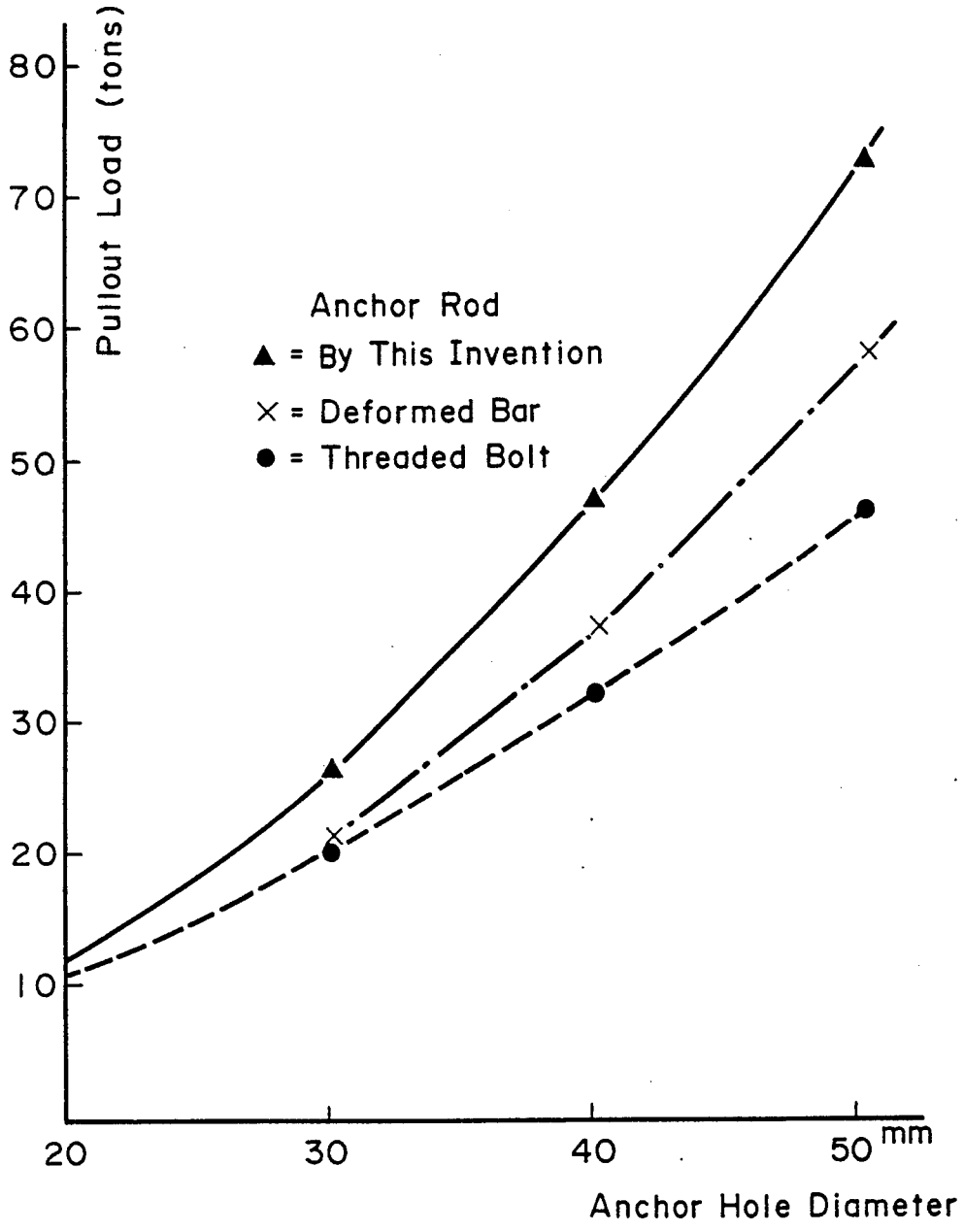
FIG. 5 is a graph comparing experimental data on anchoring strength as a function of diameter for anchors according to this invention and for conventional anchors.

FIG. 5 compares the pullout strengths for various hole diameters of three different anchor systems. The triangles show the results for an anchor system incorporating a rod according to this invention as shown in FIG. 1, the x marks show the results for a conventional deformed bar 7 like that shown in FIG. 8, and the circles show the results for a conventional bolt anchor 9 like that shown in FIG. 9. The compressive strength of the concrete body used for testing was 210 kg/cm$^2$, the hole diameters were 20, 30, 40, and 50 mm, and the hole depths were 7 times the hole diameter.

Figure 3:
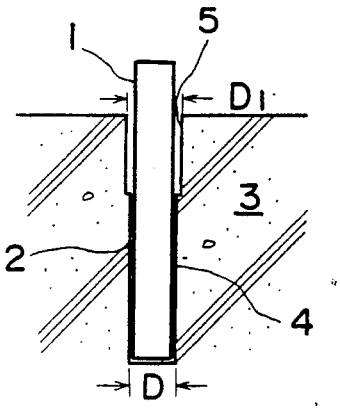
FIGS. 3 (*a*) and (*b*) and FIGS. 4 (*a*) and (*b*) illustrate the mechanical principles underlying this invention.
Figure 3:
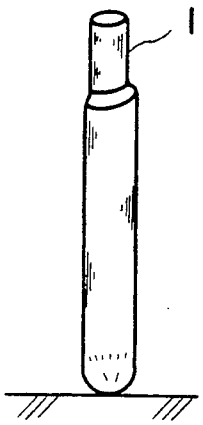

FIG. 5 clearly shows that the pullout strength of an anchor according to this invention is significantly higher than the pullout strength of conventional anchors. The larger the anchor diameter, the larger the improvement. An anchor according to this invention having a hole diameter of 30 mm gives a strength of 26.5 tons, and a conventional deformed bar anchor or bolt anchor with the same diameter gives a strength of 20.5 or 21.2 tons, respectively. As shown in FIG. 5, the differences among the strengths increase as the hole diameters increase. An anchor according to this invention is pulled out by gradual sliding after its maximum strength has been reached. As shown in FIG. 3 (*b*), the anchor has a popsicle-like shape after being pulled out, the rod being covered with the hardened cementing material and carrying some concrete fragments with it. Only a small hole is left behind in the concrete body after the rod has been pulled out. No large cone fracture of the concrete takes place.

When the aforementioned insulating sleeve 70 is used, the space between the rod 10 and the sleeve 70 can be filled tightly with the cementing material 20 so that the rod 10 in the hole is protected from rusting while the required physical insulation is ensured to prevent the first cone fracture from occurring.

Figure 2:
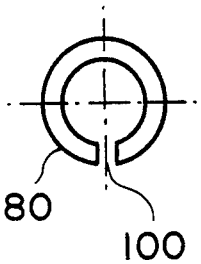
FIGS. 2 (*a*) and (*b*) are transverse cross sections of two examples of insulating sleeves.
Figure 2:
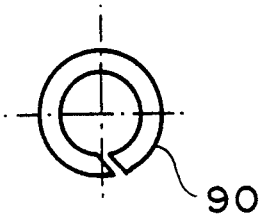

The insulating sleeve 70 can be made of an elastic pipe 80 or 90 having a split 100 formed there, as shown in FIGS. 2 (*a*) and (*b*). Due to spring action, such a sleeve 70 fits firmly inside the insulating space 50 in the upper portion of the anchor hole.

Another method of providing insulation between the anchor rod and the concrete is to apply a separating agent on the concrete surface 5 of the insulating space and leave the insulating space unfilled or filled with a material such as an organic filler.

As described in detail above, an adhesive anchor according to this invention can provide a high anchoring strength which is a direct result of the increased internal and external friction of the concrete around the anchor caused by an increase in the radial compressive stress brought about by the applied load through a wedge action. Therefore, the nearby concrete can be kept intact even after the anchor has been pulled out, and a chain-reaction failure, which is the most feared occurrence in a multi-anchor system in a row or grid installation, is prevented. Pullout of an anchor according to this invention does not damage other nearby anchors or the concrete, and it leaves only a small hole where the anchor was. Therefore, the entire structure in which the anchor is used is less susceptible to structural damage originating from an anchor failure.

The mechanical insulation as described above can be easily provided by enlarging the hole diameter slightly to the required depth and inserting a sleeve with an outer diameter which fits the enlarged hole.

What is claimed is:

1. An anchoring structure comprising:

a concrete support material having an anchor hole formed in a surface thereof; an anchor rod having a lower end which is disposed in the anchor hole and an upper end which extends above the surface of said concrete support material; and a cementing material which is filled into the anchor hole and which secures said anchor rod to the inside surface of the anchor hole.

wherein a section of said anchor rod within said anchor hole is not connected to the inside surface of the hole through said cementing material, the section extending below the surface of said concrete support material for a depth equal to at least 1.5 times the diameter of the anchor hole.

2. An anchoring structure as claimed in claim 1, wherein the anchor hole comprises an upper sleeve-shaped insulating section and a coaxially disposed lower section which has a smaller diameter than the upper section, the upper section extending from the surface of the concrete support material for a depth of at least 1.5 times the diameter of the lower section of the anchor hole.

3. An anchoring structure as claimed in claim 2, further comprising a sleeve which is inserted into the upper section of the anchor hole and insulates the anchor rod from the inner surface of the anchor hole.

4. An anchoring structure as claimed in claim 3, wherein said sleeve has a longitudinally-extending slit formed therein.

5. An anchor structure as claimed in claim 3, wherein said sleeve is made from an elastic material.

6. An anchoring structure as claimed in claim 1, wherein said anchor rod has a continuous groove formed in the periphery thereof, the depth of the groove being larger than the maximum crack width expected to appear in its vicinity in the concrete supporting material.

7. An anchoring structure as claimed in claim 6, wherein at least one surface of the groove has a slope of 15°–50°.

8. An anchoring structure as claimed in claim 6, wherein said groove is formed by a continuous spiral thread which is formed on the outer surface of said anchor rod.

9. An anchoring structure as claimed in claim 2, wherein the space between the outer surface of said anchor rod and the inner surface of the upper section of the anchor hole is empty.

10. An anchoring structure as claimed in claim 2, further comprising an organic filler which fills the space between the outer surface of said anchor rod and the inner surface of the upper section of the anchor hole.

11. An anchoring structure as claimed in claim 2, further comprising a separating agent which is applied to the inner surface of the anchor hole.

* * * * *